US010034520B1

(12) United States Patent
Jafarifar

(10) Patent No.: US 10,034,520 B1
(45) Date of Patent: Jul. 31, 2018

(54) SPORTS SHOE WITH CLEAT

(71) Applicant: Javad Jafarifar, Henderson, NV (US)

(72) Inventor: Javad Jafarifar, Henderson, NV (US)

( * ) Notice: Subject to any disclaimer, the term of this patent is extended or adjusted under 35 U.S.C. 154(b) by 0 days.

(21) Appl. No.: 15/406,685

(22) Filed: Jan. 14, 2017

(51) Int. Cl.

| | |
|---|---|
| ***A43C 15/16*** | (2006.01) |
| ***A43B 5/02*** | (2006.01) |
| ***A43B 5/10*** | (2006.01) |
| ***A43B 13/22*** | (2006.01) |
| ***A43C 15/02*** | (2006.01) |
| ***A43B 13/04*** | (2006.01) |
| *A43C 15/09* | (2006.01) |

(52) U.S. Cl.
CPC ..... *A43C 15/164* (2013.01); *A43B 5/02* (2013.01); *A43B 5/10* (2013.01); *A43B 13/04* (2013.01); *A43B 13/223* (2013.01); *A43C 15/02* (2013.01); *A43C 15/161* (2013.01); *A43C 15/09* (2013.01)

(58) Field of Classification Search
CPC ..... A43B 5/10; A43B 5/02; A43B 13/223; A43B 13/22; A43B 13/184; A43B 13/20; A43C 15/164; A43C 15/02; A43C 15/165; A43C 15/161; A43C 15/06; A43C 15/08; A43C 15/09
See application file for complete search history.

(56) References Cited

U.S. PATENT DOCUMENTS

| | | | | | |
|---|---|---|---|---|---|
| 24,269 | A * | 5/1859 | Wilton | A43C 15/161 | 36/59 R |
| 437,608 | A * | 9/1890 | Marshall | A43C 15/161 | 248/363 |
| 582,336 | A * | 5/1897 | Anderson | A43C 15/161 | 36/59 R |
| 825,869 | A * | 7/1906 | Sandeman | A43C 15/161 | 36/132 |
| 844,057 | A * | 2/1907 | Tillinghast | A43C 15/161 | 36/132 |
| 896,075 | A * | 8/1908 | Badgley | A43C 15/161 | 36/29 |
| 911,479 | A * | 2/1909 | Doughty | A43C 15/161 | 36/59 R |
| 989,514 | A * | 4/1911 | Sanford | A43B 13/223 | 248/363 |

(Continued)

FOREIGN PATENT DOCUMENTS

| | | |
|---|---|---|
| CN | 2120463 U | 11/1992 |
| DE | 20319465 U1 | 12/2003 |

*Primary Examiner* — Katharine Gracz
(74) *Attorney, Agent, or Firm* — IP Law World; Eric N. Kohli, Esq.

(57) ABSTRACT

A sports shoe with a sole comprising a novel cleat. A sports shoe may comprise a first cleat at the ball area of the sole and a second cleat at the heel area of the sole. The cleats have a circular wall that extends outward from the sole, the circular wall having a substantially straight outer surface, a graded inner surface, and a rim. The cleats are constructed of a substantially rigid material and have a front section higher than a rear section. The graded inner surface of the wall is curved. The graded inner surface of the wall has a radius of curvature that remains the same from the rim to the base and from the front section to the rear section of the cleat. In alternate embodiments the radius of curvature may vary from the rim towards the base of the cleat where the cleat connects to the sole, and from the front section of the cleat to the rear section of the cleat.

19 Claims, 3 Drawing Sheets

(56) References Cited

U.S. PATENT DOCUMENTS 1,088,115 A * 2/1914 Vaughan ..... A43B 13/223 36/59 A
1,149,186 A * 8/1915 Coleman ..... A43C 15/161 36/126
1,352,731 A * 9/1920 Egerton ..... A43B 13/223 36/59 B
1,364,570 A * 1/1921 Martin ..... A43B 13/22 36/140
1,559,450 A * 10/1925 Oakley ..... A43B 13/223 152/209.17
1,653,059 A * 12/1927 Nelson ..... A43B 13/206 36/29
2,365,027 A * 12/1944 Urbany ..... A43B 13/184 36/29
2,393,577 A * 1/1946 Urbany ..... A43B 13/04 36/29
2,424,463 A * 7/1947 Hogg ..... A43B 13/223 36/59 C
2,468,886 A * 5/1949 Lutey ..... A43B 13/223 36/28
2,756,517 A * 7/1956 Youtz ..... A43B 5/18 36/7.8
3,043,025 A * 7/1962 Semon ..... A43B 13/223 36/59 R
3,100,354 A * 8/1963 Lombard ..... A43B 13/14 36/25 R
RE26,419 E * 7/1968 Mcauliffe ..... A43B 5/02 36/103
3,466,763 A * 9/1969 Levin ..... A43B 5/02 36/126
3,676,940 A * 7/1972 Shively ..... A43B 5/08 248/362
4,096,649 A * 6/1978 Saurwein ..... A43B 13/223 36/32 R
4,494,320 A * 1/1985 Davis ..... A43B 13/223 36/103
4,494,321 A * 1/1985 Lawlor ..... A43B 5/06 36/25 R
RE33,066 E * 9/1989 Stubblefield ..... A43B 7/144 36/30 R
4,893,421 A * 1/1990 Folks ..... A43B 5/18 36/116
5,075,984 A * 12/1991 Shiew ..... A43B 3/16 36/113
6,434,860 B1 * 8/2002 Turos ..... A43C 15/161 36/134
9,204,687 B1 * 12/2015 Piontkowski ..... A43B 1/0054
9,392,842 B2 * 7/2016 Piontkowski ..... A43B 13/145
9,622,541 B2 * 4/2017 Yang ..... A43B 13/223
2002/0100190 A1 * 8/2002 Pellerin ..... A43B 5/00 36/126
2005/0108902 A1 * 5/2005 McMullin ..... A43B 5/001 36/127
2006/0117609 A1 6/2006 Guichard
2007/0054791 A1 * 3/2007 Langer ..... A63B 21/0004 482/146
2008/0216362 A1 * 9/2008 Gerber ..... A43B 5/02 36/67 A
2011/0247243 A1 * 10/2011 Eder ..... A43B 13/26 36/67 A
2011/0277351 A1 * 11/2011 Scoledes ..... A43B 5/10 36/103
2013/0067777 A1 * 3/2013 Minami ..... A43B 13/22 36/59 R
2015/0313310 A1 * 11/2015 Okamoto ..... A43B 13/14 36/31
2016/0037857 A1 * 2/2016 Foxen ..... A43B 13/125 36/103

* cited by examiner

SPORTS SHOE WITH CLEAT

FIELD OF THE INVENTION

The present invention relates to the art of footwear.

CROSS REFERENCE TO RELATED APPLICATIONS

Not applicable.

STATEMENT REGARDING FEDERALLY-SPONSORED RESEARCH AND DEVELOPMENT

Not applicable.

BACKGROUND

Articles of clothing, apparel, shoes, accessories, and the like, for athletes and sports participants are known in the art. They are constantly evolving to assist sports participants improve performance in the sport as well as to decrease injuries or physical wear and tear to their body. This is important due to increased player-safety awareness and the personal as well as financial consequences of sports injuries to athletes. As a result increased amount of research and funding is being poured into providing improved clothing, apparel, shoes, accessories, and the like, for athletes and sports players.

Athletes and sports players nowadays participate in sports at various competitive levels. These include, for example, intra-school, intra-college, and professional levels. General sports participants, however, play sports for the fun of the sport, for general exercise, or as a social or entertainment activity. But in each circumstance and at every level, the sport and its risks remain unchanged. There is a perpetual need for safety as well as a performance advantage because they are always beneficial to a sports player, and the player's clothing, apparel, shoes or accessories are generally designed to help provide such benefits.

Athletes and sports players participate in a countless number of sports. Typical and more popular sports include soccer, football, baseball, basketball, etc. However, the comprehensive list is virtually endless, with sports like volleyball, lacrosse, field hockey, squash, badminton, cricket, tennis, fencing, table tennis, handball, and more. But no matter the sport, the desired underlying goal remains the same—enhanced player safety and enhanced performance in the sport—and the player's clothing, apparel, shoes or accessories are generally designed to help provide such benefits.

Sports are physically strenuous activities which are usually quite demanding on the human body. Sudden movements due to the quick responsiveness required by the sport take their toll on the player's body during a game. These movements come in all shapes and forms, and usually require a twist or torsion of a limb or a portion of the body. Such twists and torsions are internally damaging to the human body, such as to the muscles, ligaments, joints, bones, and the like. When severe enough, such twists and torsions can result in injury to the player, sometimes even long-term or permanent injury, knocking the player out of the sport.

An example of a sport that frequently requires quick or sudden twists or torsion by players is soccer. The players are constantly running up and down the field as the ball routinely changes direction. The players continuously have to reorient themselves in response to the changing direction of play. If a player is directly involved with the ball, he may selectively change the direction of play by kicking the ball in a different direction, or even kick a reverse shot. Such a reverse shot could exert up to a 180 degree torsion in the player's body. Further, because the energy expended in kicking a soccer ball requires excessive force by a player, such torsional forces on the player's body are potentially dangerous and can cause injury, particularly to the player's knee, ankle, and muscular structure, some of which may be irreversible.

Another problem players experience is maintaining reliable footing as they make a difficult reverse shot or a shot that causes torsional stress on their body. Shoes with cleats designed to provide a non-slip footing may plant the player's foot firmly on the ground, but as the player's body twists or contorts to kick the ball in a different direction with force with his other foot, or knee, the resulting torsional stress on the ankle, knee, bones and muscles can be severe and damaging as the firmly-planted first foot does not yield.

Sports players and institutions who support or sponsor players typically look at apparel and gear to help prevent such injuries, and to assist players in making such difficult athletic maneuvers. Improved shoes, medical wraps, elastic bandages, etc, are some solutions that have been implemented towards these goals. However, these solutions have limited effectiveness and restrict the player's attempts at sudden or complex athletic maneuvers. They almost never assist the player's torsional maneuvers. Further, they carry only a small ability to help decrease the likelihood of injury to the player.

The problem of providing reliable footing is usually solved by cleats or spikes under the soles of shoes that tend to grip the ground and prevent slippage as the player puts his weight on his foot inside his shoes. Such cleats, however, have narrow edges and small crevices that tend to accumulate debris such as grass, mud, soil, and the like. This debris tends to interfere with the design and function of the cleats, and sometime may accumulate enough to cause discomfort or unstable footing for the player.

Cleats or spikes under the soles of shoes designed to grip the ground and prevent slippage have an additional drawback of the potential for inflicting injury during play. If a player wearing such shoes falls, or steps on another fallen player, or even engages in an aggressive maneuver with his foot such as kicking a soccer ball aggressively or at a height, there is an inherent risk of injury to the player himself or to other players from the relatively sharp cleats and spikes on the soles of his shoes.

Accordingly, there is a need for gear or apparel to help sports players execute complex athletic actions, such as torsional maneuvers, and to help decrease the likelihood of injury while executing such complex athletic actions. Ideally, there is a need for gear or apparel that would both help sports participants execute complex athletic actions, such as torsional maneuvers, as well as help decrease the likelihood of injury while executing such complex athletic actions. There is also a need for cleats that would not accumulate debris while a player is engaged in a sport. There is also a need for cleats with a shape and design that carries a decreased likelihood of injury to players while playing the sport.

SUMMARY

Sports shoes typically have cleats on their soles. The cleats serve to provide stable footing for an athlete, or sports player, to help prevent skidding or slippage during sudden or aggressive physical maneuvers while engaged in a sport.

In one embodiment, a circular cleat is provided on the sole under the ball area of the foot. The cleat has a large diameter and its edges extend close to the edges of the sole at the ball area of the foot.

The cleat has a circular wall that extends outwards from the sole. The height of the wall may vary across the circumference of the cleat. The wall has an outer surface, a graded inner surface, and a rim. The rim may have a rounded shape. The grade of the inner surface of the wall is curved, and may vary across the circumference of the cleat. The outer surface of the wall is between ¼ inch and one inch from two opposite edges of the sole.

The cleat has a front section, which is closer to the front of the shoe, and a rear section, which is closer to the back of the shoe. The height of the wall at the front section may be greater than the height of the wall at the rear section of the cleat.

The cleat has a base located at the opposite end from the rim of the wall. The cleat is connected to the sole at the base. The wall of the cleat is thickest at the base, and its thickness narrows from the base towards the rim.

The graded inner surface of the wall has a radius of curvature that remains the same across the cleat. In an alternate embodiment, this radius of curvature may vary from the rim towards the base. In another embodiment, this radius of curvature may vary from the front section of the cleat to the rear section of the cleat.

In one embodiment, a second cleat is provided on the sole under the heel area of the foot. The second cleat has a smaller diameter compared to the first cleat, and its outer edges are less than ¼ inch from two opposite edges of the sole. In one embodiment, its outer edge is close to being flush with the back edge of the sole. In an alternate embodiment, the second cleat is flush with the back edge of the sole. In other aspects, the shape and construction of the second cleat is similar to the first cleat.

In one embodiment, the cleat or cleats are constructed integrally with the sole. In an alternate embodiment, the cleat or cleats are constructed separately and are substantially rigidly attached to the sole, such as with an adhesive. In one embodiment the cleat or cleats are constructed of material comprising nylon or polytetrafluoroethylene stock. One skilled in the art knows that some of these materials are commercially available under the mark TEFLON.

Other utility, methods, construction, features, advantages, and uses of this invention will become apparent from the disclosure, figures and description provided herein. All such utility, methods, construction, features, advantages and uses are included within this summary and the description provided herein as they are anticipated and are intended to fall within the scope and spirit of this invention. They are intended to be covered and protected by the claims below.

BRIEF DESCRIPTION OF THE DRAWINGS

The invention can be better understood with reference to the drawings and description provided herein. In the figures, like reference numerals designate corresponding parts throughout the different figures and views.

DETAILED DESCRIPTION

The description and accompanying figures correspond to sports shoes and to cleats for sports shoes. Sports shoes with some type of cleats on their soles are generally known in the art and are utilized across a broad spectrum of sports. Such sports include soccer, football, tennis, field hockey, and the like. The cleats of the present invention have utility in shoes for a significant majority of sports that require physical activity or mobility from the player, which will be evident to one skilled in the art based on the description and accompanying drawings provided herein.

Figure 1:
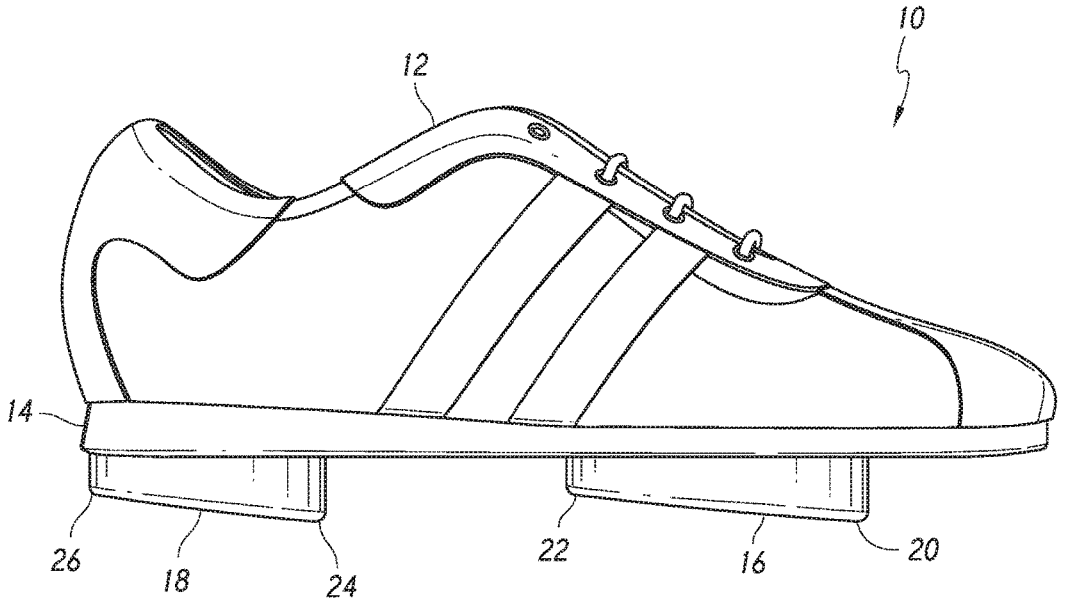
FIG. 1 is a lateral side elevational view of a sports shoe.

Referring to the drawings, FIG. 1 shows a sports shoe 10 that an athlete, or a sports player, would wear on his feet. The sports shoe 10 has an upper portion 12, a sole 14, a first cleat 16, and a second cleat 18. The first cleat 16 and second cleat 18 project outward from the sole 14. The first cleat 16 is located on the sole 14 at roughly under the ball area of the player's foot, while the second cleat 18 is located on the sole 14 at roughly under the heel area of the player's foot.

The first cleat 16 has a front section 20 located towards the front, or toe area, of the shoe 10, and a rear section 22 located towards the back, or heel area, of the shoe 10. The second cleat 18 has a front section 24 located towards the front, or toe area, of the shoe 10, and a rear section 26 located towards the back, or heel area, of the shoe 10.

As shown in FIG. 1, in one embodiment of the present invention the height of cleat 16 is greatest at front section 20 and smallest at rear section 22. In another embodiment, the height of the second cleat 18 is greatest at front section 24 and smallest at rear section 26. In one embodiment, front section 20 is about ¾" high and rear section 22 is about ¼" high. In another embodiment, front section 24 is about ¾" high and rear section 26 is about ¼" high.

Figure 2:
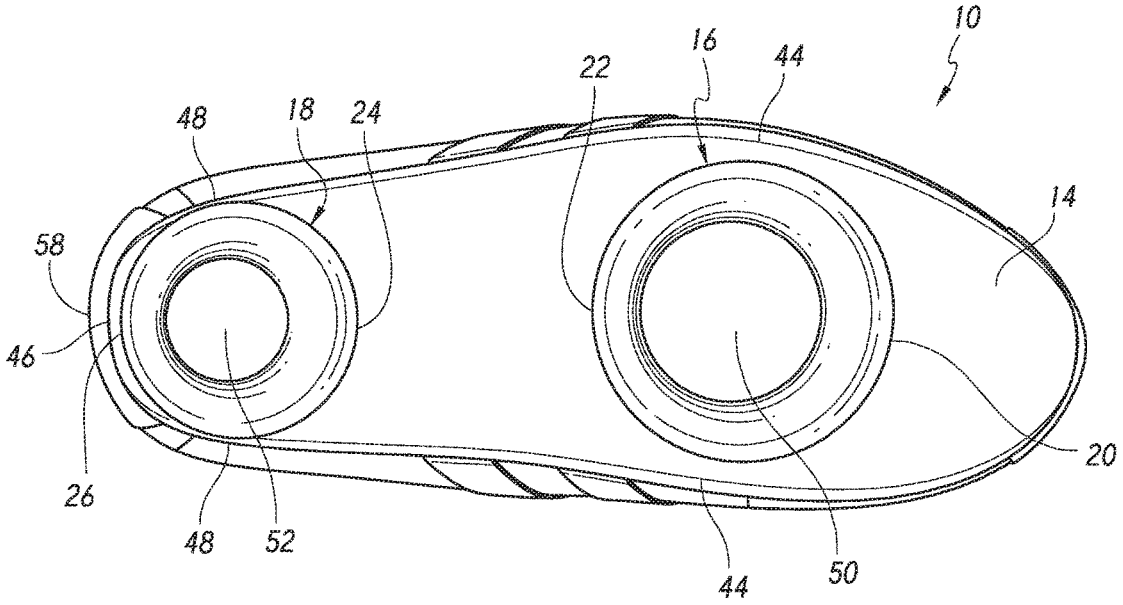
FIG. 2 is a bottom view of the sports shoe of FIG. 1.

FIG. 2 shows the first cleat 16 and the second cleat 18 from the bottom.

First cleat 16 is circular in shape. An outer periphery of the first cleat 16 reaches about ¼ inch from edges of the sole 14 at two opposite edges 44 of the sole 14. In other embodiments, the outer periphery of the first cleat 16 may range from one inch to being flush with two opposite edges 44 of the sole 14. In one embodiment, first cleat 16 has a diameter of about four inches. However, it is anticipated that the diameter of the first cleat 16 will vary from one embodiment to another, depending on the particular sport the shoe 10 is intended for, the size of the shoe, the player's preferences, and the like, and may be more or less than four inches. All such embodiments that do not deviate from the spirit and scope of the present invention are anticipated and are intended to be covered by the claims.

Second cleat 18 is circular in shape. An outer periphery of the second cleat 18 reaches about ¼ inch from edges of the sole 14 at two opposite edges 48 of the sole 14. In other embodiments, the outer periphery of the second cleat 18 may range from ¼ inch to being flush with two opposite edges 48 of the sole 14. In one embodiment, the outer periphery of the second cleat 18 is less than ¼ inch from the back edge 58 of the sole 14. In another embodiment, the outer periphery of the second cleat 18 is flush with the back edge 58 of the sole 14. In one embodiment, second cleat 18 has a diameter of about three inches. However, it is anticipated that the diameter of the second cleat 18 will vary from one embodiment to another, depending on the particular sport the shoe 10 is intended for, the size of the shoe, the player's preferences, and the like, and may be more or less than three inches. All such embodiments that do not deviate from the spirit and scope of the present invention are anticipated and are intended to be covered by the claims.

Figure 3:
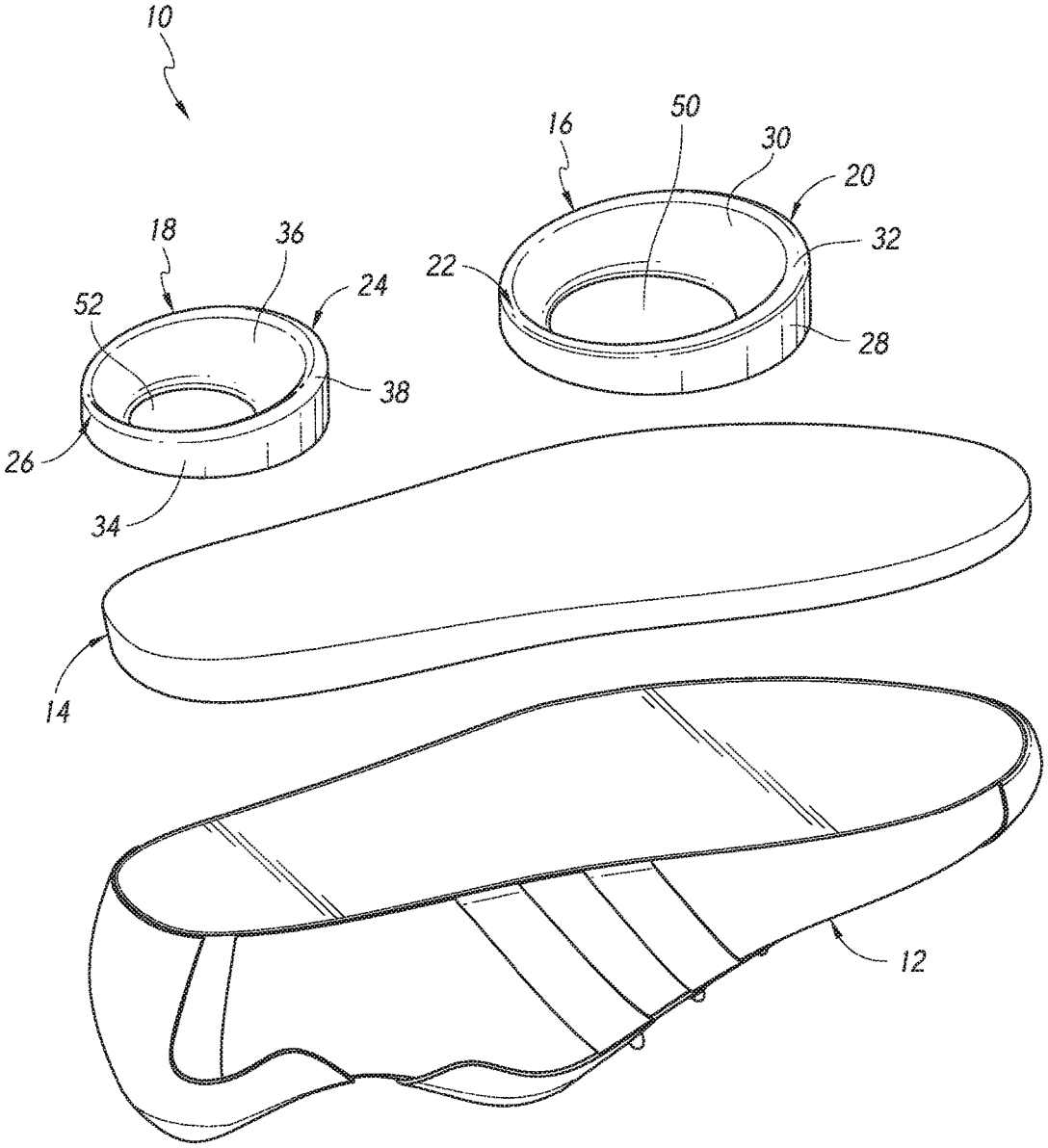
FIG. 3 is an exploded view of an upper portion, a sole and cleats comprising the sports shoe of FIG. 1.

Referring to FIG. 3, the sports shoe 10 is shown in an exploded view. First cleat 16 and second cleat 18 are shown separated from the sole 14.

Figure 5:
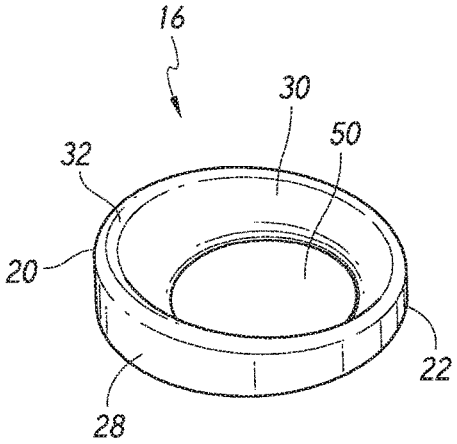
FIG. 5 is a top perspective view of a cleat of the sports shoe of FIG. 1.
Figure 6:
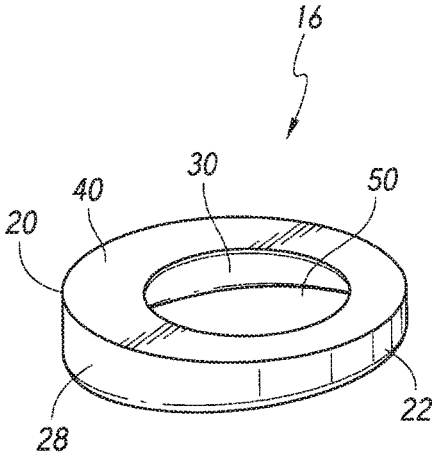
FIG. 6 is a bottom perspective view of the cleat of FIG. 5.

Referring to FIGS. 5 and 6, first cleat 16 comprises a wall with an outer surface, or outer wall 28, and an inner surface, or inner wall 30. Outer wall 28 and inner wall 30 meet to form a rim 32. The rim 32 has a rounded surface in one embodiment. In another embodiment, the rim 32 has a semi-circular profile. Outer wall 28, inner wall 30 and rim 32 run the entire circular periphery of the first cleat 16. The inner wall 30 forms a cavity 50, and the area inside cavity 50 is empty.

Second cleat 18 comprises a wall with an outer surface, or outer wall 34, and an inner surface, or inner wall 36. Outer wall 34 and inner wall 36 meet to form a rim 38. The rim 38 has a rounded surface in one embodiment. In another embodiment, the rim 38 has a semi-circular profile. Outer wall 34, inner wall 36 and rim 38 run the entire circular periphery of the second cleat 18. The inner wall 36 forms a cavity 52, and the area inside cavity 52 is empty. In one embodiment, second cleat 18 is substantially similar in shape and design as first cleat 16. In another embodiment, they are substantially similar in shape and design, and first cleat 16 has a larger diameter than second cleat 18.

Figure 4:
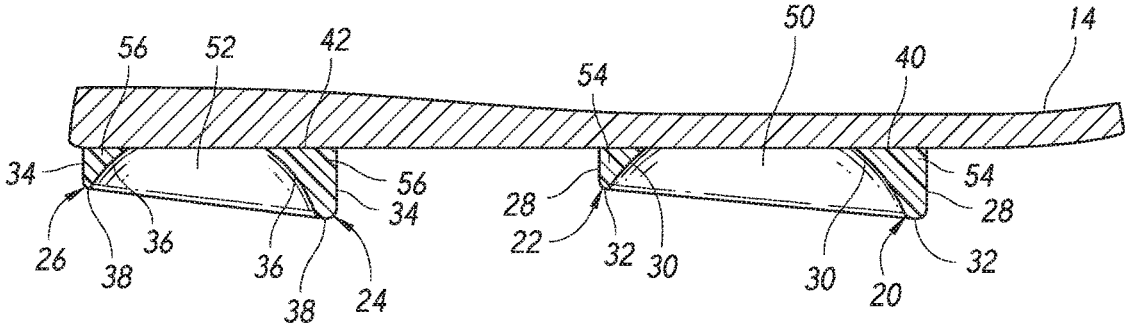
FIG. 4 is a partial cross-sectional view of the sole and cleats of the sports shoe of FIG. 1.

Referring to FIG. 4, a partial cross sectional view of the sole 14, first cleat 16 and second cleat 18 is shown. First cleat 16 is attached at its base 40 to the sole 14 substantially rigidly, and second cleat 18 is attached at its base 42 to the sole 14 substantially rigidly. The base 40 of first cleat 16 is located at the opposite end from rim 32, and the base 42 of second cleat 18 is located at the opposite end from rim 38.

In one embodiment, outer wall 28 of first cleat 16 is substantially straight, although it is anticipated that outer wall 28 may be angular, curved, or another shape, without deviating from the spirit and scope of the present invention. In another embodiment, first cleat 16 is substantially perpendicular to the sole 14. All such variations and embodiments of the outer wall 28 are anticipated and intended to be covered by the claims.

In one embodiment, the inner wall 30 of first cleat 16 has a graded surface. As depicted in the cross-sectional view in FIG. 4, the graded surface of the inner wall 30 is curved. The curvature of the graded surface of the inner wall 30 resembles the outer surface of a sphere, whereby the curvature may be defined by a radius of the curvature. The radius of the curvature of the inner wall 30 is constant across the first cleat 16 in one embodiment. Because of this curvature, the first cleat 16 is thickest at the base 40 and narrowest at the rim 32. It is understood that the curvature of the graded surface of the inner wall 30 will vary from one embodiment to another, and will depend on various factors such as the sport that the shoe 10 is intended for. All such variations and embodiments are anticipated and fall within the spirit and scope of the present invention.

In other embodiments, the radius of curvature of the inner wall 30 may vary across the first cleat 16. In one embodiment, the radius of curvature of the inner wall 30 varies from the rim 32 to the base 40, with the radius of curvature increasing from the base 40 towards the rim 32. A decreasing radius of curvature from the rim 32 towards the base 40 provides a greater slope, or angle, to the inner wall 30 from the rim 32 to the base 40. In another embodiment, the radius of curvature of the inner wall 30 is greater at rear section 22 than at front section 20. This difference in curvature of the inner wall 30 between front section 20 and rear section 22 is shown in the cross-sectional view of the first cleat 16 in FIG. 4.

The width of the rim 32 will depend on the curvature of the graded surface of the inner wall 30 and the distance between the inner wall 30 and outer wall 28. If the radius of curvature of the graded surface of the inner wall 30 varies across the first cleat 16, the width of the rim 32 will also vary across the first cleat 16. In one embodiment the width of the rim 32 is about ¼" at front section 20 and about ⅛" at rear section 22. However, one skilled in the art will recognize that the width of the rim 32 can be varied from one embodiment to another to meet desired performance objectives from the shoe 10 without deviating from the spirit and scope of the present invention. All such embodiments, therefore, are anticipated and are intended to be covered by the claims.

As shown in FIG. 4, the width 54 of the first cleat 16, which is the distance between inner wall 30 and outer wall 28, varies between the base 40 and the rim 32. The width 54 narrows from the base 40 towards the rim 32 with the curvature of the graded inner wall 30. The width 54 of the first cleat 16 will also vary across the first cleat 16 with the radius of curvature of the graded inner wall 30 in an embodiment where the radius of curvature of the graded inner wall 30 varies.

In one embodiment, the inner wall 30, the outer wall 28, and area forming the width 54 between them comprise of the same material and they are integrally constructed as one contiguous unit. In another embodiment the area forming the width 54 is hollow while inner wall 30 and outer wall 28 may be constructed of different materials. One skilled in the art will recognize that the inner wall 30, outer wall 28 and the area forming the width 54 may be constructed in numerous ways without deviating from the spirit and scope of the present invention. All such embodiments are anticipated and are intended to be covered by the claims.

In one embodiment, the outer wall 34 of the second cleat 18 is substantially straight, although it is anticipated that outer wall 34 may be angular, curved, or another shape, without deviating from the spirit and scope of the present invention. In another embodiment, second cleat 18 is substantially perpendicular to the sole 14. All such variations and embodiments of the outer wall 34 are anticipated and intended to be covered by the claims.

In another embodiment, the inner wall 36 of the second cleat 18 has a graded surface. As depicted in the cross-sectional view in FIG. 4, the graded surface of the inner wall 36 is curved. The curvature of the graded surface of the inner wall 36 resembles the surface of a sphere, whereby the curvature may be defined by a radius of the curvature. This radius of the curvature of the inner wall 36 is constant across the second cleat 18 in one embodiment. Because of this curvature, the second cleat 18 is thickest at the base 42 and narrowest at the rim 38. It is understood that the curvature of the graded surface of the inner wall 36 will vary from one embodiment to another, and will depend on various factors, such as the sport that the shoe 10 is intended for. All such variations and embodiments are anticipated and fall within the spirit and scope of the present invention.

In other embodiments, the radius of curvature of the inner wall 36 may vary across the second cleat 18. In one embodiment, the radius of curvature of the inner wall 36 varies from the rim 38 to the base 42, with the radius of curvature increasing from the base 42 towards the rim 38. A decreasing radius of curvature from the rim 38 towards the base 42 provides a greater slope, or angle, to the inner wall 36 from the rim 38 to the base 42. In another embodiment, the radius of curvature of the inner wall 36 is greater at rear section 26 than at front section 24. This difference in curvature of the inner wall 36 between front section 24 and rear section 26 is shown in the cross-sectional view of the second cleat 18 in FIG. 4.

The width of the rim 38 will depend on the curvature of the graded surface of the inner wall 36 and the distance between the inner wall 36 and the outer wall 34. If the radius of curvature of the graded surface of the inner wall 36 varies across the second cleat 18, the width of the rim 38 will also vary across the second cleat 18. In one embodiment the width of the rim 38 is about ¼" at front section 24 and about ⅛" at rear section 26. However, one skilled in the art will recognize that the width of the rim 38 can be varied from one embodiment to another to meet desired performance objectives from the shoe 10 without deviating from the spirit and scope of the present invention. All such embodiments, therefore, are anticipated and are intended to be covered by the claims.

As shown in FIG. 4, the width 56 of the second cleat 18, which is the distance between inner wall 36 and outer wall 34, varies between the base 42 and the rim 38. The width 56 narrows from the base 42 towards the rim 38 with the curvature of the graded inner wall 36. The width 36 of the second cleat 18 will also vary across the second cleat 18 with the radius of curvature of the graded inner wall 36 in an embodiment where the radius of curvature of the graded inner wall 36 varies.

In one embodiment, the inner wall 36, the outer wall 34, and area forming the width 56 between them comprise of the same material and they are integrally constructed as one contiguous unit. In another embodiment, the area forming the width 56 is hollow while inner wall 36 and outer wall 34 may be constructed of different materials. One skilled in the art will recognize that the inner wall 36, the outer wall 34 and the area forming the width 56 may be constructed in numerous ways without deviating from the spirit and scope of the present invention. All such embodiments are anticipated and are intended to be covered by the claims.

The first cleat 16 and the second cleat 18 may be constructed from any one of, or any combination of, a wide variety of materials known in the art. In one embodiment, the first cleat 16 is constructed from a thick nylon or polytetrafluoroethylene stock. In another embodiment, the second cleat 18 is constructed from a thick nylon or polytetrafluoroethylene stock. In one embodiment, the first cleat 16 is constructed from a compound of rubber. In another embodiment, the second cleat 18 is constructed from a compound of rubber.

It is anticipated that the material, or combination of materials, utilized for constructing the first cleat 16 or the second cleat 18 will depend on the particular sport the sports shoe 10 is intended for, the age or weight of the player, the size of the shoe, the type of surface that the sport will be played on, and the like. However, all such materials or combination of materials are anticipated and fall within the spirit and scope of the present invention They are all, therefore, intended to be covered by the claims.

In one embodiment, the first cleat 16 is integrally constructed with the sole 14. In an alternate embodiment, the first cleat 16 is constructed separately from the sole 14 and is attached to the sole 14 substantially rigidly, such as with an adhesive.

In one embodiment the second cleat 18 is integrally constructed with the sole 14. In an alternate embodiment, the second cleat 18 is constructed separately from the sole 14 and is attached to the sole 14 substantially rigidly, such as with an adhesive.

It is anticipated that one skilled in the art may determine other ways to construct or attach the first cleat 16 or the second cleat 18 to the sole 14. All such embodiments, however, are anticipated and fall within the spirit and scope of the present invention, All such embodiments, therefore, are intended to be covered by the claims.

One skilled in the art will recognize that the cleat of the present invention provides several benefits for a sports shoe. A player wearing the shoe 10 would cause either the rim 32 of the first cleat 16 or the rim 38 of the second cleat 18, or both, to contact the floor when he takes a step. However, because the first cleat 16 is highest at front section 20 and the second cleat 18 is highest at front section 24, the player's weight will bear substantially on front section 20 or front section 24, or both. These limited points of contact with the ground, pushed downward by the force of the player's weight, will help plant the player's foot on the ground and resist slippage as he makes sudden physical motions such as running and stopping.

This benefit of firm footing on the ground is enhanced when the player steps on a surface such as a field where most sports are played. Such sports fields typically comprise a grass covered soft ground, but may comprise artificial turf on either a hard or a soft surface, a carpeted indoor surface, or the like. In most such situations, the cleats of the present invention will help provide the player's foot firm footing on the surface of the field when he steps down by resisting slippage because of the limited points of contact with the ground being pushed against the ground by the force of the player's weight. The front portions of the cleats will at least partially sink into the grass, the turf, the carpeting, or comparable surface, and be pinned in position. Additionally, the remainder of each cleat may be further held in place by any objects protruding from the ground, such as grass or turf, which may temporarily enter and occupy the cavity 50 or cavity 52, or both, in the cleats when the player takes a step.

The cleats of the present invention provide the player the benefit of executing complex athletic maneuvers with a reduced risk of injury. When a player is actively playing a physical sport, his foot usually flexes at the arch as he moves his feet to take a step, to run, to kick a ball, or the like. Some of these moves are abrupt and require a quick change in direction. In soccer, for example, the player may need to turn quickly to engage the ball or to make a reverse shot with force. With the shoe 10, as the player's foot flexes, his weight will come to rest on the rim 32 or 38 of one of the two cleats. That circular rim 32 or 38 on the cleat will allow the player the flexibility to pivot on the ball area of his foot or the heel area of his foot, depending on which cleat his weight is resting on. The player would be able to pivot at the location where his foot is positioned at the time, without a high risk of slipping. Due to this pivoting ability, the player will be able to reorient his body in any direction, rotating on the rim 32 or 38 of one of the cleats 16 or 18, and execute with force abrupt physical maneuvers required for the sport being played. The ability to rotationally pivot on a foot would help reduce the likelihood of injuring an ankle or a knee, or damaging soft tissue, during such aggressive physical maneuvers while playing the sport.

The cleats of the present invention may assist the player continue playing without the need to clean debris or other foreign materials from the cleats under his shoes frequently.

The first cleat 16 has a cavity 50 and a the second cleat 18 has a cavity 52. There is no other location on the cleats 16 or 18 where debris or foreign materials may accumulate as the surface of each cleat is smooth with no crevices.

As for debris, or foreign materials, that may enter the cavity 50 during sports activity, the curvature of the graded inner wall 30 helps guide such materials backward from the front section 20 towards the rear section 22 of the first cleat 16. Such guiding action is assisted by the player stepping on the ground and putting his weight on the first cleat 16. Grass, turf, or other material on the ground, or field, will temporarily enter the cavity 50 when the player steps on the cleat 16. Upon entering the cavity 50, such material will apply an upward force on the debris present in the cavity 50. In response to such force the debris will travel back towards the rear section 22, guided by the curvature of the graded inner wall 30 at the front section 20.

As the debris travels from the front section 20 towards the rear section 22 of the first cleat 16, the debris will start exiting the cavity 50 and get discarded. The front section 20 of the first cleat 16 will be blocked due to being in contact with the ground. The rear section 22, on the other hand, would be open as it is shorter and would not be in contact with the ground. The height of the first cleat 16 varies between the front section 20 and the rear section 22, and its height is greatest at the front section 20 and shortest at rear section 22. This decrease in height of the first cleat 16 from front section 20 towards rear section 22 creates an opening between the ground and the rim 32 of the first cleat 16. As a result, portions of the debris would begin exiting the cavity 50 through the opening between the ground and the rim 32 when the debris is being guided towards the rear section 22.

Some remaining debris will reach the rear section 22. To assist the debris to eventually exit the cavity 50 from the rear section 22, the curvature of the inner wall 30 at rear section 22 helps guide the debris and foreign materials to exit the cavity 50 as the force of the contents of the ground, such as grass or turf, which temporarily enter the cavity 50 when the player steps on the ground, pushes it against the curved surface of the graded inner wall 30 at rear section 22.

In one embodiment, the radius of curvature of the inner wall 30 at the rear section 22 of the first cleat 16 is greater than the radius of curvature of the inner wall 30 at the front section 20. The greater radius of curvature of the inner wall 30 at rear section 22 creates a comparatively flatter surface on the sides and top of the cavity 50 at rear section 22, which helps guide the debris out of the cavity 50. The debris is thereby expelled from the opening between the rim 32 at rear section 22 and the ground, and is discarded. This process is continuously assisted by the player's stepping actions, which applies the force of his weight on the first cleat 16, pushing it against the ground and causing the contents of the ground, such as grass or turf, to temporarily enter the cavity 50 and exert a force on the debris in the cavity 50, where the curved surface of the inner wall 30 guides it.

In one embodiment, the radius of curvature of the inner wall 30, which varies across the first cleat 16, increases from the front section 20 towards the rear section 22. This increasing radius of curvature of the inner wall 30 assists in increasing the expelling of debris from the cavity 50 as the debris travels from the front section 20 towards the rear section 22.

It is anticipated that the inner wall 30 can have a different shape, angle, slope, curvature or design to assist in increasing the guiding and expelling of debris from the cavity 50 as the debris travels from the front section 20 towards the rear section 22. All such embodiments fall within the scope and spirit of the present invention and are intended to be covered by the claims.

As for debris, or foreign materials, that may enter the cavity 52 during sports activity, the curvature of the graded inner wall 36 helps guide such materials backward from the front section 24 towards the rear section 26 of the second cleat 18. Such guiding action is assisted by the player stepping on the ground and putting his weight on the second cleat 18. Grass, turf, or other material on the ground, or field, may temporarily enter the cavity 52 when the player steps on the cleat 18. Upon entering the cavity 52, such material will apply an upward force on the debris present in the cavity 52. In response to such force the debris will travel back towards the rear section 26, guided by the curvature of the graded inner wall 36 at the front section 24.

As the debris travels from the front section 24 towards the rear section 26 of the second cleat 18, the debris will start exiting the cavity 52 and get discarded. The front section 24 of the second cleat 18 will be blocked due to being in contact with the ground. The rear section 26, on the other hand, would be open as it is shorter and would not be in contact with the ground. The height of the second cleat 18 varies between the front section 24 and the rear section 26, and its height is greatest at the front section 24 and shortest at rear section 26. This decrease in height of the second cleat 18 from front section 24 towards rear section 26 creates an opening between the ground and the rim 38 of the second cleat 18. As a result, portions of the debris would begin exiting the cavity 52 through the opening between the ground and the rim 38 while the debris is being guided towards the rear section 26.

Some remaining debris will reach the rear section 26. To assist the debris to eventually exit the cavity 52 from the rear section 26, the curvature of the inner wall 36 at rear section 26 helps guide the debris and foreign materials to exit the cavity 52 as the force of the contents of the ground, such as grass or turf, which temporarily enter the cavity 52 when the player steps on the ground, pushes it against the curved surface of the graded inner wall 36 at rear section 26.

In one embodiment, the radius of curvature of the inner wall 36 at the rear section 26 of the second cleat 18 is greater than the radius of curvature of the inner wall 36 at the front section 24. The greater radius of curvature of the inner wall 36 at rear section 26 creates a comparatively flatter surface on the sides and top of the cavity 52 at rear section 26, which helps guide the debris out of the cavity 52. The debris is thereby expelled from the opening between the rim 38 at rear section 26 and the ground, and is discarded. This process is continuously assisted by the player's stepping actions, which applies the force of his weight on the second cleat 18, pushing it against the ground and causing the contents of the ground, such as grass or turf, to temporarily enter the cavity 52 and exert a force on the debris in the cavity 52, where the curved surface of the inner wall 36 guides it.

In one embodiment, the radius of curvature of the inner wall 36, which varies across the second cleat 18, increases from the front section 24 towards the rear section 26. This increasing radius of curvature of the inner wall 36 assists in increasing the expelling of debris from the cavity 52 as the debris travels from the front section 24 towards the rear section 26.

It is anticipated that the inner wall 36 can have a different shape, angle, slope, curvature or design to assist in increasing the guiding and expelling of debris from the cavity 52 as the debris travels from the front section 24 towards the rear section 26. All such embodiments fall within the scope and spirit of the present invention and are intended to be covered by the claims.

Although the present invention has been described in considerable detail with regard to preferred embodiments, alternate embodiments and anticipated variations, other variations are possible. The claims below should not be limited to the descriptions of specific embodiments above.

I claim:

1. A sports shoe, comprising:

a sole having a ball portion and a heel portion;

a first cleat having a first base, a first inner wall, and a first outer wall, said first cleat connected at said first base to the ball portion of the sole, wherein the first cleat projects outward from the sole, the first cleat is made from a rigid material, the first cleat has a front section located towards a front of the sports shoe and a rear section located towards a back of the sports shoe, said first inner wall and said first outer wall meet to form a first rim located opposite to said first base, said first rim is a circle, and said first inner wall extends from said first base to said first rim, a height of the first cleat between the first base and the first rim at the front section of the first cleat continuously varies from a height of the first cleat between the first base and the first rim at the rear section of the first cleat, said first inner wall is convexly curved with respect to a center of said first rim, said first outer wall is less than 1 inch from two opposite edges of the sole and the height of the first cleat between the first base and the first rim is greatest at the front section and least at the rear section.

2. The sports shoe of claim 1, wherein the first inner wall has a graded surface, and a thickness between the first inner wall and the first outer wall is greatest at the first base and least at the first rim.

3. The sports shoe of claim 2, wherein the graded surface of the first inner wall has a vertical radius of curvature in the same direction as the first inner wall extending from the first base and the first rim, and said vertical radius of curvature increases from the first base towards the first rim.

4. The sports shoe of claim 2, wherein the thickness between the first inner wall and the first outer wall varies from the front section of the first cleat towards the rear section of the first cleat, and is greatest at the front section of the first cleat and least at the rear section of the first cleat;

the graded surface of the first inner wall has a radius of curvature in a lateral direction with respect to the first inner wall extending from the first base to the first rim, said radius of curvature varies from the front section of the first cleat towards the rear section of the first cleat; and said radius of curvature of the first inner wall in said lateral direction increases from the front section of the first cleat towards the rear section of the first cleat.

5. The sports shoe of claim 1, wherein the sole has a second cleat having a second base, a second inner wall, a second outer wall, said second cleat connected at said second base to the heel portion of the sole, wherein the second cleat projects outward from the sole, said second inner wall and said second outer wall meet to form a second rim located opposite to said second base, the second rim is a circle, and said second inner wall extends from said second base to said second rim, said second inner wall is convexly curved with respect to a center of said second rim, and said second outer wall is ¼ inch or less from two opposite edges of the sole.

6. The sports shoe of claim 5, wherein the second cleat has a front section located towards a front of the sports shoe and a rear section located towards a back of the sports shoe, a height of the second cleat between the second base and the second rim at the front section of the second cleat varies from a height of the second cleat between the second base and the second rim at the rear section of the second cleat, and the height of the second cleat between the second base and the second rim is greatest at the front section of the second cleat and least at the rear section of the second cleat.

7. The sports shoe of claim 6, wherein the height of the first cleat between the first base and the first rim at the front section of the first cleat is about ¾ inch, the height of the first cleat between the first base and the first rim at the rear section of the first cleat is about ¼ inch, the height of the second cleat between the second base and the second rim at the front section of the second cleat is about ¾ inch, and the height of the second cleat between the second base and the second rim at the rear section of the second cleat is about ¼ inch.

8. The sports shoe of claim 5, wherein the first inner wall has a graded surface, a thickness between the first inner wall and the first outer wall is greatest at the first base and least at the first rim, the second inner wall has a graded surface, a thickness between the second inner wall and the second outer wall is greatest at the second base and least at the second rim.

9. The sports shoe of claim 8, wherein the graded surface of the first inner wall has a similar radius of curvature from the first base to the first rim in the same direction as the first inner wall extending from the first base and the first rim, and the graded surface of the second inner wall has a similar radius of curvature from the second base to the second rim in the same direction as the second inner wall extending from the second base and the second rim.

10. The sports shoe of claim 8, wherein the graded surface of the first inner wall has a first radius of curvature in the same direction as the first inner wall extending from the first base and the first rim, and said first radius of curvature increases from the first base towards the first rim, and the graded surface of the second inner wall has a second radius of curvature in the same direction as the second inner wall extending from the second base and the second rim, and said second radius of curvature increases from the second base towards the second rim.

11. The sports shoe of claim 8, wherein the second cleat has a front section located towards a front of the sports shoe, the second cleat has a rear section located towards a back of the sports shoe, the graded surface of the first inner wall has a similar radius of curvature in a lateral direction with respect to the first inner wall extending from the first base to the first rim from the front section of the first cleat to the rear section of the first cleat, and the graded surface of the second inner wall has a similar radius of curvature in a lateral direction with respect to the second inner wall extending from the first base to the first rim from the front section of the second cleat to the rear section of the second cleat.

12. The sports shoe of claim 8, the second cleat has a front section located towards a front of the sports shoe, the second cleat has a rear section located towards a back of the sports shoe, the thickness between the second inner wall and the second outer wall varies from the front section of the second cleat towards the rear section of the second cleat, and is greatest at the front section of the second cleat and least at the rear section of the second cleat;

the graded surface of the second inner wall has a radius of curvature in a lateral direction with respect to the second inner wall extending from the second base to the second rim, said radius of curvature varies from the front section of the second cleat towards the rear section of the second cleat; and said radius of curvature of the second inner wall in said lateral direction increases from the front section of the second cleat towards the rear section of the second cleat.

13. The sports shoe of claim 1, wherein the first cleat is constructed integrally with the sole.

14. The sports shoe of claim 1, wherein the first cleat is constructed separately and attached to the sole.

15. The sports shoe of claim 1, wherein the first inner wall and the first outer wall are constructed of a material comprising nylon stock.

16. The sports shoe of claim 1, wherein the first inner wall and the first outer wall are constructed of a material comprising polytetrafluoroethylene.

17. The sports shoe of claim 1, wherein the first outer wall has a diameter of between 2 and 4 inches.

18. The sports shoe of claim 5, wherein the first outer wall has a diameter of between 2 and 4 inches and the second outer wall has a diameter of between 1 and 3 inches.

19. The sports shoe of claim 18, wherein the second outer wall is less than ¼ inch from a back edge of the sole.

* * * * *